US005667378A

United States Patent [19]

Bushman

[11] Patent Number: 5,667,378

[45] Date of Patent: Sep. 16, 1997

[54] LOW PROFILE KILN APPARATUS

[75] Inventor: James Bushman, Pittsburgh, Pa.

[73] Assignee: Swindell Dressler International Company, Pittsburgh, Pa.

[21] Appl. No.: 403,743

[22] PCT Filed: Sep. 11, 1992

[86] PCT No.: PCT/US92/07648

§ 371 Date: May 4, 1995

§ 102(e) Date: May 4, 1995

[87] PCT Pub. No.: WO94/07100

PCT Pub. Date: Mar. 31, 1994

[51] Int. Cl.[6] ..... F27D 3/12

[52] U.S. Cl. ..... 432/241; 432/137; 432/144

[58] Field of Search ..... 432/5, 6, 136, 432/137, 141, 241, 78, 144

[56] References Cited

U.S. PATENT DOCUMENTS

| | | | |
|---|---|---|---|
| 1,908,186 | 5/1933 | Robertson | 432/241 |
| 3,038,711 | 6/1962 | Gummeson et al. | 432/78 |
| 3,170,681 | 2/1965 | Davies | 432/47 |
| 3,204,341 | 9/1965 | Whitsel, Jr. | 432/12 |
| 3,322,413 | 5/1967 | Orth | 432/5 |
| 3,759,659 | 9/1973 | Bay | 432/24 |
| 3,778,221 | 12/1973 | Bloom | 432/11 |
| 3,868,094 | 2/1975 | Hovis | 432/54 |
| 4,030,879 | 6/1977 | Stanasila et al. | 432/144 |
| 4,128,394 | 12/1978 | Naito et al. | 432/137 |
| 4,249,895 | 2/1981 | Mantegani | 432/128 |
| 4,348,175 | 9/1982 | Molina | 432/241 |
| 4,384,848 | 5/1983 | Marazzi | 432/11 |
| 4,444,557 | 4/1984 | Kimura et al. | 432/137 |
| 4,527,974 | 7/1985 | Carraroli et al. | 432/78 |
| 4,560,346 | 12/1985 | Schulz | 432/24 |
| 4,596,526 | 6/1986 | Soliman | 432/23 |
| 4,718,847 | 1/1988 | Manson | 432/241 |
| 4,773,850 | 9/1988 | Bushman et al. | 432/5 |
| 4,773,851 | 9/1988 | Mueller | 432/241 |
| 4,778,384 | 10/1988 | Lingl, Jr. | 432/241 |

OTHER PUBLICATIONS

"The One High Kiln in 1972" by F.E. Jeffers, Brick & Clay Record, Apr. 1972.

"One high features production cycle of less than 24 hrs." by Leo E. Oberschmidt, Brick & Clay Record, Oct. 1967, pp. 50–52.

"General Shale's—The One high", by J.J. Svec, Brick & Clay Record, Oct. 1967, pp. 48–49, and 82, 85.

*Primary Examiner*—Noah P. Kamen

*Attorney, Agent, or Firm*—Cushman Darby & Cushman IP Group of Pillsbury Madison & Sutro LLP

[57] ABSTRACT

The present invention relates to an apparatus (1) efficiently producing brick (53). More specifically, the invention relates to an automated, ultra low profile, continuously moving dryer, kiln and brick handling system which provides efficient, effective heating of the brick, and wherein the kiln uses only top burners (34). The invention thus eliminates the need for burners placed both on top and below the kiln or in other positions throughout the kiln, to provide effective heating.

9 Claims, 5 Drawing Sheets

LOW PROFILE KILN APPARATUS

BACKGROUND OF THE INVENTION

The present invention relates to an apparatus for efficiently producing brick. More specifically, the invention relates to an automated, ultra low profile, continuously moving dryer, kiln and brick handling system which provides efficient, effective heating of the brick, and wherein the kiln uses only top burners. The invention thus eliminates the need for burners placed both on top and below the kiln or in other positions throughout the kiln to provide effective heating.

In a typical brick making process, unfired (green) bricks are stacked on the deck of a kiln car traveling on tracks through the kiln. The bricks are typically stacked on the kiln car in piles of about 14 bricks high. The brick stacks may have different configurations but typically the bricks are stacked so as to minimize the thickness of the stack, thereby allowing the hot gases in the kiln to more quickly and evenly heat the brick. The brick stacks are typically arranged in rows, with rows being separated by a distance of 2 to 6 inches which allows better hot gas circulation resulting in quicker and more even firing of the bricks. Brick producing plants producing bricks in this manner typically use a kiln firing time on the order of 30–80 hours, depending upon the particular raw material used to make the brick. Such lengthy firing times are necessary due to the amount and manner in which the bricks are passed through the kiln.

Some brick making systems use a "low profile" dryer and kiln. A typical low profile system uses a stack of bricks from 1–8 high. Such a low profile system is disclosed in Applicant's prior U.S. Pat. No. 4,773,850. This patent discloses a low profile dryer and kiln, in combination with low mass kiln cars carrying stacks of bricks from high 1–8, which is able to utilize a greatly shortened drying and firing cycle. The present invention is an improvement over Applicants prior U.S. Pat. No. 4,773,850, the disclosure of which is incorporated herein by reference thereto.

SUMMARY OF THE INVENTION

The present invention provides an ultra-low profile brick making system, i.e., one limited to a stack of bricks no greater than two bricks high. The invention also provides a continuously moving system, i.e., a system wherein a load of green bricks moves continuously through a kiln without interruption. Further the invention is able to achieve effective and efficient firing of the brick by providing a kiln having heating elements or burners only in the top of the kiln. There are no burners provided in the bottom of the kiln, as is done in all other known continuously moving kilns.

Figure 1:
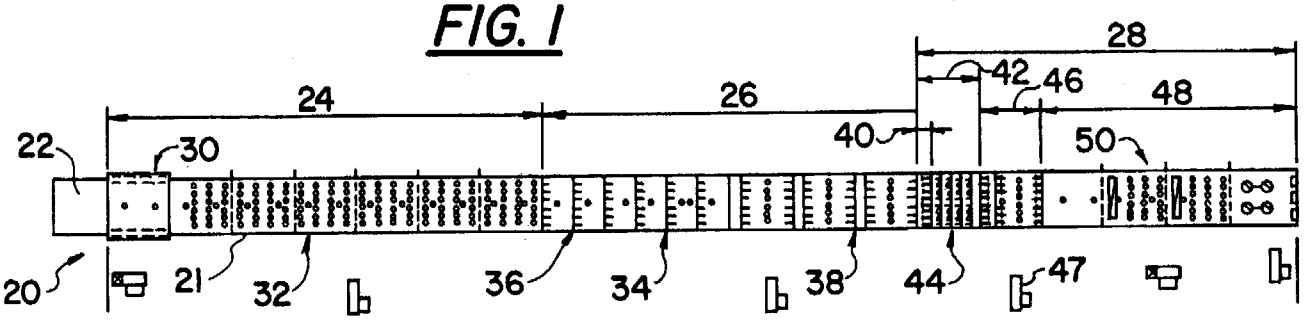
FIG. 1 is a top view of tunnel kiln according to the invention.

Although specific forms of apparatus have been selected for illustration in the drawings and although specific terminology will be resorted to in describing those embodiments in the specification appearing hereinafter, it will be apparent to those skilled in the art that the illustrated and described embodiments are merely examples within the broad scope of the present invention as defined in the appended claims.

DETAILED DESCRIPTION OF THE INVENTION

A typical brick producing facility is illustrated in Applicant's prior U.S. Pat. No. 4,773,850. As disclosed therein raw brick material, typically comprising a mixture of clay, water and optionally other known additives, is formed into green bricks. The green bricks are loaded onto a kiln car and continuously conveyed through a dryer and kiln. In accordance with the present invention, the bricks are stacked to a maximum of two bricks high.

Although bricks may be cut to any number of sizes, the brick of commercial brick comes in either 8" of 12" sizes. Individual 8" green bricks typically have standard dimensions on the order of 2.4"×4.0"×8.6" and weigh about 5 to 6 lbs. Twelve inch green bricks typically have dimensions of 3.9"×3.9"×12.5" and weigh about 13 to 14 lbs.

The green bricks typically have a water content in the range of about 12 to 16% after extrusion. If bricks having such a high moisture content were introduced into a kiln, the bricks would explode due to the rapid build-up of steam within the brick. In order to avoid this problem the bricks must first be dried in a dryer before introducing them into the kiln.

In accordance with the present invention, any dryer may be used to remove moisture from the green brick. The preferred design, operation, equipment and construction of the dryer is generally in accordance with the following description. However, it will be recognized by those skilled in the art that other dryers may also be used.

Figure 3:
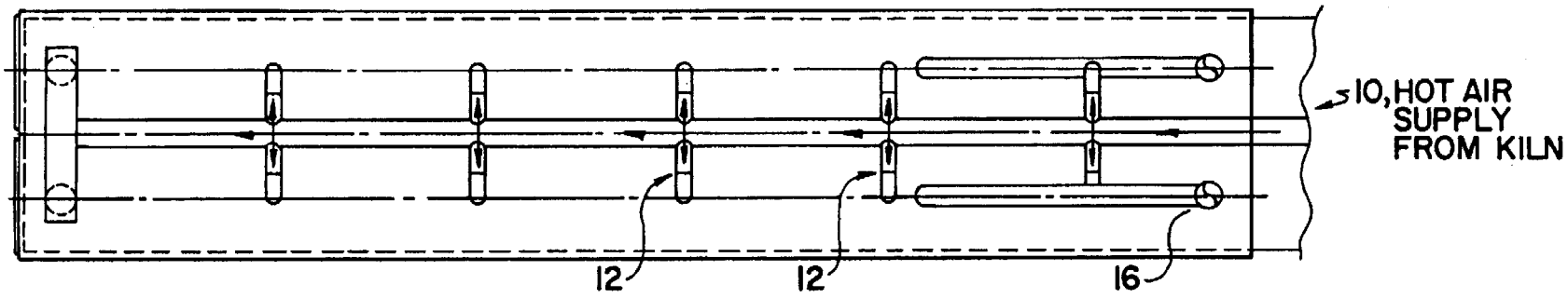
FIG. 3 is a top plan view of a dryer used in conjunction with the invention.
Figure 3A:
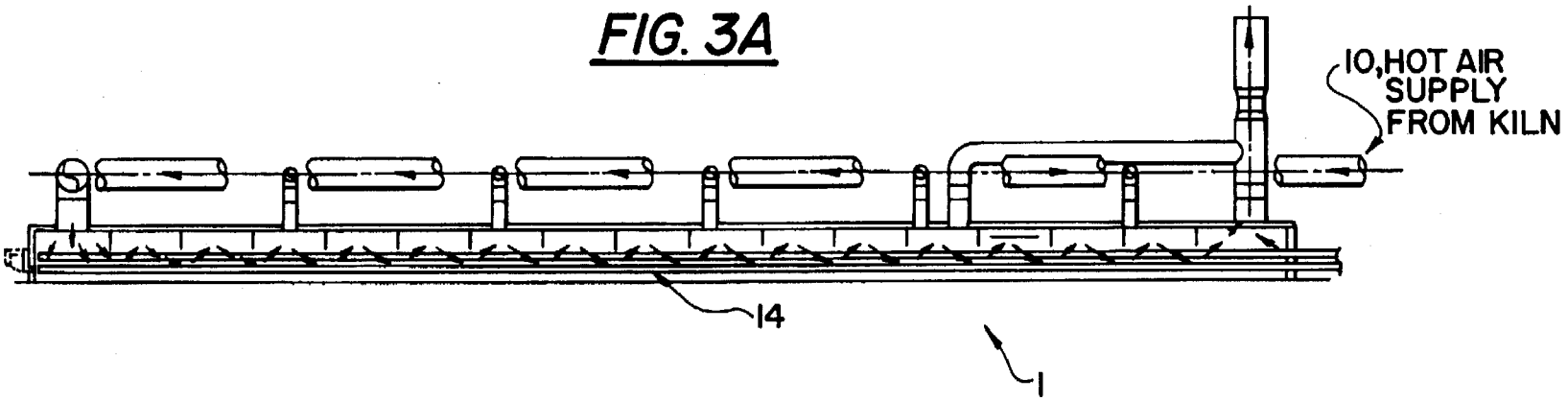
FIG. 3A is a sectional elevation of a dryer used in conjunction with the present invention.
Figure 4:
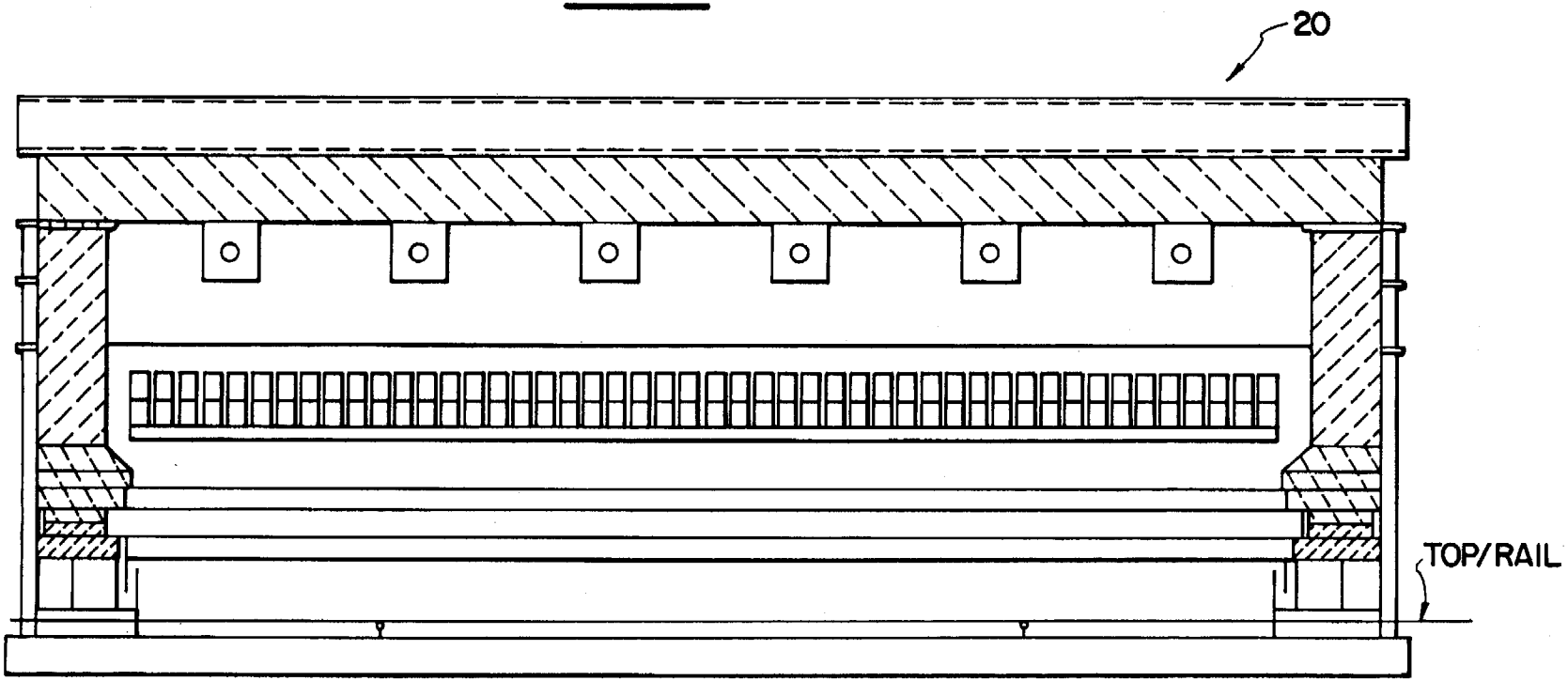
FIG. 4 is a cross-section of the furnace zone in the kiln of the present invention.

Preferably, the dryer 1 is a twin track tunnel dryer, as shown generally in FIGS. 3 and 3A. The dryer structure preferably consists of building brick walls and a hollow core reinforced concrete plank roof. Sand troughs for sand sealing of kiln cars may be provided. Hot air 10 is supplied to the dryer from the kiln by a centrifugal fan with the air discharging into each tunnel via roof slots 12. A waste heat duct and a waste heat spill (not shown) fitted on the discharge of the dryer supply fan may be provided to allow discharge of excess volume, if necessary. A motorized ambient air inlet damper (not shown) is provided to allow for temperature control of the dryer hot air supply.

Dryer recirculation is accomplished by a series of hinged, motorized baffles 14. The baffles preferably are located at every ¾ car length along the dryer length. The basic function of the baffles is to recirculate the air down through the load after the air flows up through the load by natural convection. The number of vertical recirculations and the volume of each is controlled by the movements of the baffles. The baffles may be programmed so that each baffle can be constantly moving to provide a wiping action to the load as well as automatic control of the dryer pressure and temperature profile.

Preferably, all dryer exhaust fans 16 are mounted on the dryer roof. These may include were cool exhaust/dryer supply fans and dryer exhaust fans.

The residence time of the bricks in the dryer 1 (i.e., the drying cycle) is typically on the order of about 4–28 hours. The drying cycle of the dryer is significantly less than conventional prior art drying cycles which typically range from about 30 to 60 hours.

Figure 2:
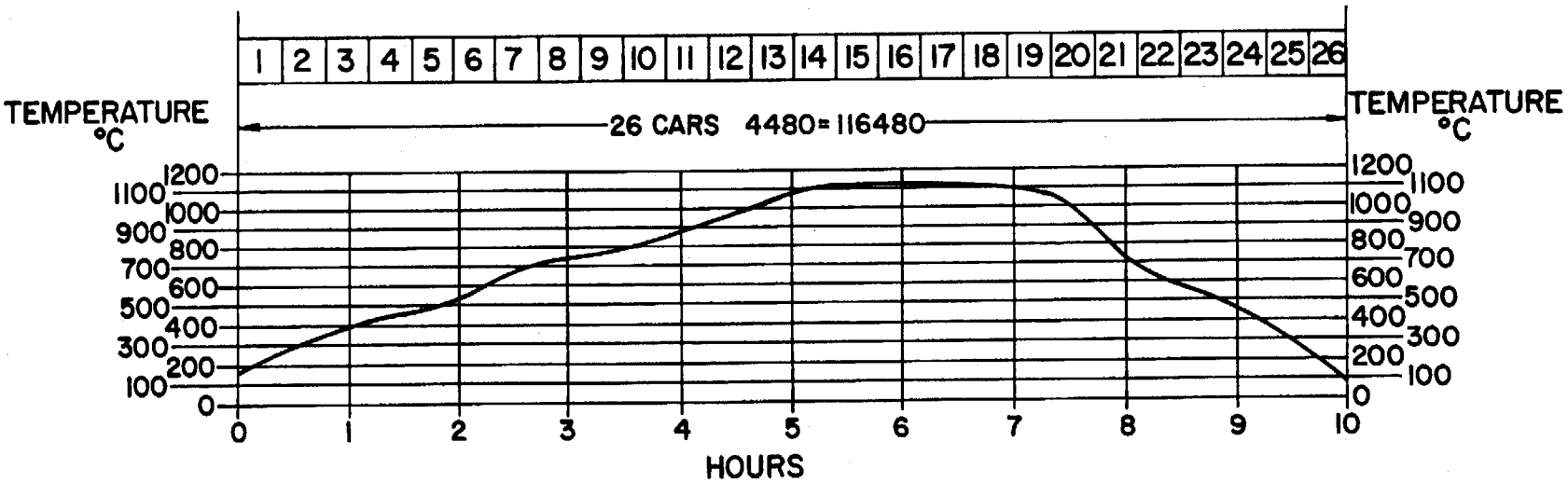
FIG. 2 is a temperature profile for a kiln according to the invention.

The present invention uses an ultra-low profile tunnel kiln 20 shown in FIG. 1. In one specific example of the invention described herein, the kiln design is based on the kiln longitudinal/theoretical time-temperature curve shown in FIG. 2. This temperature is representative of the kiln atmosphere as indicated by crown thermocouples. The preferred fuel for heating the kiln is natural gas, although other heat sources may, of course, be used. The kiln is designed for oxidized firing, flashing or continuous reduction after firing to peak temperature. The kiln operates automatically in all three modes of firing.

The kiln in its preferred form includes an entrance vestibule/air lock 22. The kiln preferably is designed in 20 feet (6.1 meter) long sidewall modules having an exterior shell of 3/16 in. thick steel sheet. The sidewall insulation of the kiln is ceramic fiber modules. The modules will vary in thickness and density in accordance with zone temperature along the kiln as appropriate.

The kiln roof 21 is flat suspended panels of ceramic fiber modules of the appropriate density and thickness. The panels are approximately 5'–0 (1.5 meters) long by kiln width, constructed of fiber lined expanded metal. The kiln roof panels are bolted to the kiln sidewalls. This design allows for replacement of roof sections to add or delete burners or roof jets, or increase sidewall height. In the event production rates or operation requirements create the necessity for design revision to the kiln, it can be accomplished with a minimum of difficulty and downtime.

The kiln modules are completely constructed including refractories, fiber, burners, piping and electrical components. Modules can be bolted together at the plant site and all necessary connections completed.

Sand seals may be provided on each side of the kiln to minimize leakage between the under car area and the ware space.

The kiln is provided with two vertical lift doors not shown, counter weighted and driven by geared motor drives. The doors at the kiln entrance form a one car long entrance vestibule 22 to receive an incoming car from the dryer. The inner door will be closed at all times except when a car is charged into the kiln. The outer door will be closed only when the kiln charges a car into the offtake zone. The entrance vestibule, with at least one door always closed, will create an air lock at the kiln entrance to minimize upsetting of the kiln draught during kiln car charging.

In one example of the invention, the kiln includes a preheat zone 24, a furnace zone 26, and a cooling zone 28. The kiln preheat zone 24 is approximately nine and one half (9½) cars long and is the early heating zone through which the combustion gases from the firing zone are drawn to preheat the load. The preheat zone 24 includes a kiln offtake portion 30 of the zone is approximately one and one half (1½) cars long. Exhaust gases are drawn from the kiln via wall offtakes above and below load level via insulated stainless steel ductwork to the kiln exhaust fan. The kiln exhaust fan will discharge through an exhaust stack to a suitable height above factory roof level. The kiln exhaust inlet damper is controlled by an electric motor to automatically control kiln pressure in the firing zone. Additional control of the preheat zone temperature is accomplished with a series of roof mounted ceramic nozzles or jets 32. In a preferred form of the invention, these nozzles 32 are arranged in twenty-three rows of six nozzles per row, and each row has a butterfly valve for manual control. All of the nozzles 32 are located in the roof of kiln.

In one example of the invention, the furnace zone 26 of the kiln is approximately eight cars long and is the heating zone in which the peak temperature is attained. A plurality of high velocity gas burners 34 are located in this zone in the roof of the kiln. In the preferred form of the invention, a total of seventy-two high velocity gas burners will be installed throughout the firing or furnance zone. All of the burners are located above the kiln car. There are no burners below the kiln car, as in the prior known designs. The top only burner design is effective and efficient for firing bricks that are stacked two high.

The early furnace zone burners 36 preferably are located in the kiln roof in six rows of six burners across the width of the kiln. The burners fire at an inclined angle from the flat roof toward the load, counter to kiln travel. Each row of burners is controlled as one temperature zone via a thermocouple located in the center of the kiln roof. These burners will be oscillated in pairs of rows (three pairs of two rows). As the air pressure increases in row one, it will decrease in row two, and so on through row six. As row one reaches maximum pressure, row two will be at minimum, and then the process reverse itself. The fuel/air ratio will remain constant throughout.

The remaining furnace zone burners 38 are located in three elevated sections of kiln roof, each with two rows of six burners firing opposed to one another, parallel to kiln travel, across the kiln width. Again, all of the burners are in the roof. There are no burners in the kiln floor. Each pair of opposed burners is an automatic temperature control zone across the car load. A control thermocouple is located at midpoint of the elevated roof sections at each burner pair.

The burners form an oscillating combustion front which sweeps from end to end of the elevated roof section. The oscillating combustion front is accomplished by two motorized combustion air valves operating simultaneously at predetermined flow rates. As combustion air pressure is increased on one end, it is decreased on the opposite end. When pressure reaches the maximum on one end and the minimum on the opposite end, the process reverses. The fuel/air ratio remains constant by means of cross connected regulator in the fuel line which receives its impulse pressure from the combustion air header. The entire combustion system preferably utilizes Swindell Dressier's Dyna-Max™ Combustion System. This system moves the burner output gases back and forth across the load. The sweeping action of the burner flames results in an even flow of hot gases through the cross section of the load, thus increasing combustion gas recirculation.

The oscillating combustion front enables the burners to be operated at a fuel-air ratio closer to the stoichiometric than normally possible, thus increasing efficiency of heat treating the load while minimizing the hot spotting experienced with static firing. The burners also entrain kiln atmosphere by a venturi effect, thus creating a secondary recirculating effect.

Temperature control preferably is by means of fuel input control with motorized adjustable port valves. One feature of this combustion system is that all burner gas inputs are individually adjustable by means of a limiting orifice valve in the gas line. The flows are measurable by means of the metering orifice. The maximum temperature in the firing zone in this example is approximately 1125° C.

In one example of the invention, after the main firing zone in the kiln there is the cooling zone 28. The cooling zone 28 includes approximately a one third car length "dead" zone 40 of kiln and a recuperation/reduction zone 42 which is approximately one car length. Reduction preferably is accomplished by introducing raw gas into the kiln via twenty-four lances 44 through the kiln roof, in four rows of six lances per row. Each gas lance is fitted with an isolating valve, limiting orifice valve and metering orifice to allow individual adjustment of gas input. The reduction zone 42 is designed to provide indirect cooling capability to allow flashed or reduced products to be cooled, without injecting cooling air into the zone.

The recuperation/reduction zone 42 of the kiln provides a car length separation between the furnace zone 26 and a rapid cool zone 46, which is part of general cooling zone 28. This indirect cooling system brings previously unachievable control to the production of flashed and reduced products. The zone 46 is equipped with an alloy tube recuperator system to work as an air-to-air heat exchanger mounted between the top of the load and the underside of the roof of the kiln.

Cooling air for the recuperator is provided by the kiln recuperation air blower. The recovered heat is used in the firing zone combustion system. The recuperation system includes a natural draft automatically dampered spill stack to provide for protection cooling flow through the tubes incase of power failure. The damper is designed to open upon power loss.

The rapid cooling zone 46 in the kiln is approximately one car long. Rapid cooling is accomplished by injecting ambient air into the kiln via alloy jets if mounted in an elevated section of the kiln roof.

In the preferred form of the invention, a total of twelve jets are provided, six on each side of the elevated roof section in an opposed pattern across the kiln width. The rapid cool jets are oscillated in similar manner to the furnace zone burner system. Each air jet is provided with a butterfly valve for individual adjustment. The rapid cool zone 46 is provided with an ambient air blower 47 and a motorized air damper to provide automatic temperature control in the zone. A control thermocouple is located at the center of this zone.

In the example discussed herein, the general cooling zone 28 further includes a ware cooling zone 48 in the kiln which is approximately five and one half cars long. Cooling air input is provided by the exit end supply fan. Three rows of six ceramic roof nozzles 50 inject air from a rapid cool blower into the kiln, above the load of brick and counter to kiln car travel to drive cooling air down through the load. Cooling zone roof offtakes may be provided for adjustment of cooling zone offtake air to shape the cooling zone temperature profile.

To minimize the tendency for ambient air to be drawn into the ware space from between the cars and via the sand seals, an undercar pressure balance system may be provided. An undercar exhaust fan draws air from the undersides of the kiln cars. The volume of air exhausted is automatically controlled to maintain the desired pressure beneath the cars. Baffles provided beneath the kiln cars isolate the undercar system.

Figure 7:
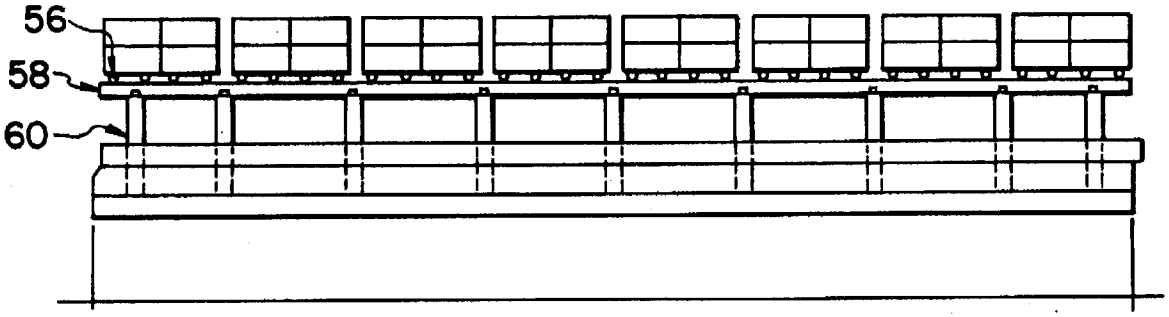
FIG. 7 is a side elevation of a kiln car used in the present invention.

When the kiln car 52 travels through the kiln 20, the bricks 53 are stacked only to a maximum height of 2 bricks, as shown in FIG. 7.

Figure 5:
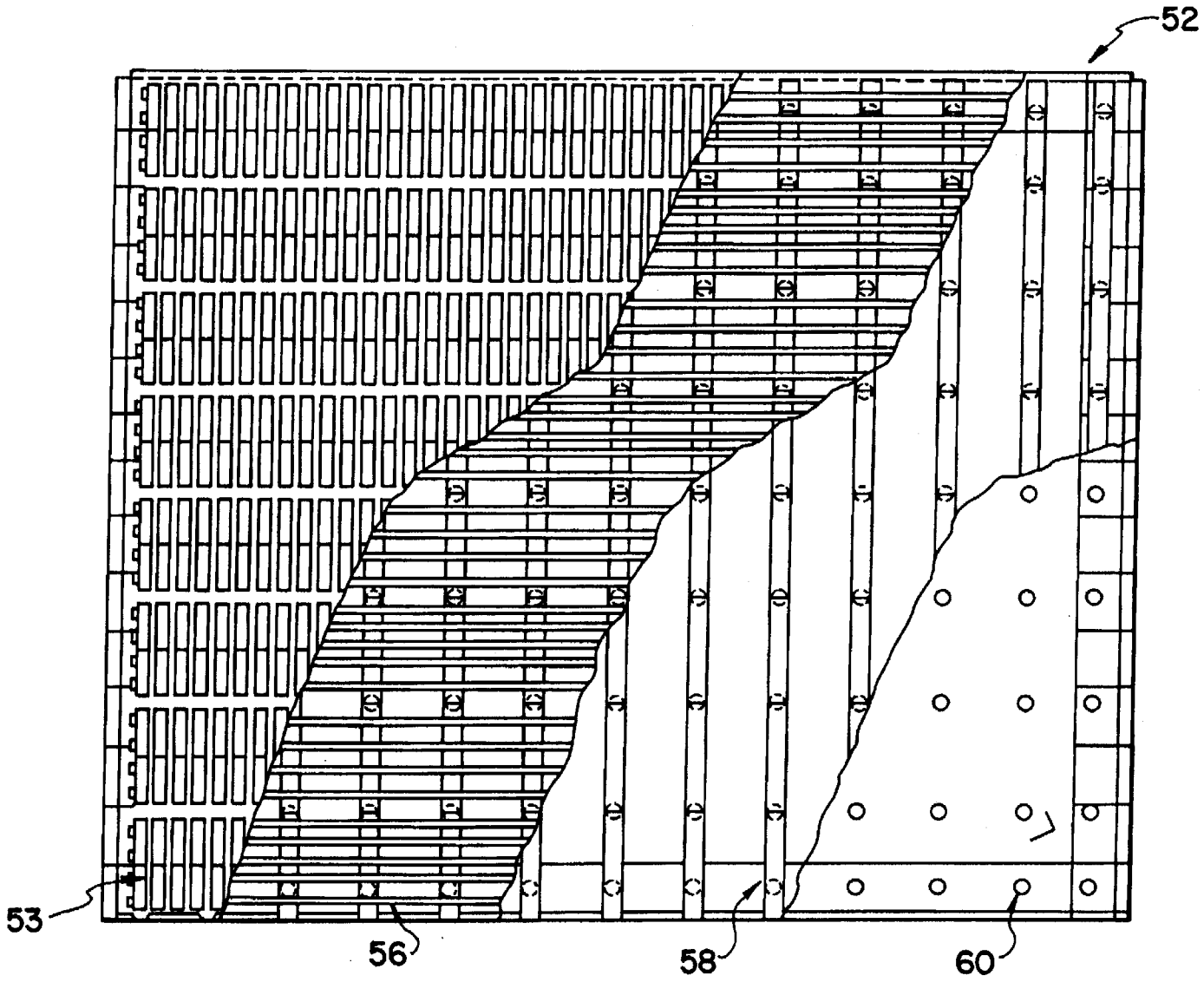
FIG. 5 is plan view of a kiln car used in the present invention.
Figure 6:
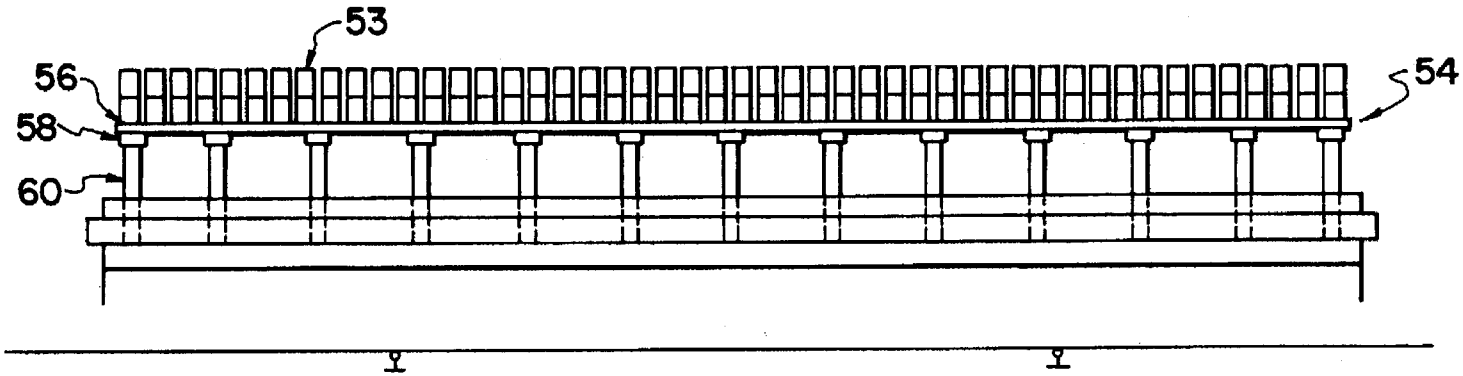
FIG. 6 is rear elevation of a kiln car used in the present invention.

As shown in FIGS. 5–7, preferably, the brick setting pattern in the kiln cars of two high edge set brick will be supported by a brick ware support deck 54 in an open grid pattern. This brick ware support deck will consist of stringers 56 spanning between cordierite beams 58 supported by hollow refractory posts 60 anchored into the kiln car steelwork. This provides a level of lightweight car deck to support the load. This deck arrangement is also very open to allow for even and quick drying and firing of the brick ware.

The refractory insulation (superstructure) of the kiln car will be constructed of the dense ceramic fiber modules. High density accordion pleated modules are placed around the car perimeter. These modules are cut closely to the kiln bench profile to provide a car side seal to the bench. The modules along the leading and trailing edge of the car project beyond the car steel. When two cars come together these modules adjoin and compress to form a tight radiation shield and convection seal.

In addition to having low heat storage, the fiber kiln car design eliminates hard refractory joints at the car interior. This feature eliminates the adverse effects resulting from coating sands, brick chips, or other debris which might fall into the joints between hard refractory pieces. With no open expansion joints for debris to collect in, fiber modules remain in place and eliminate the common displacement problems experienced with traditional hard refractory kiln car designs. In the preferred form of the invention, the kin car refractory system will consist of the following: a base made from 1800° F. ceramic fiber blanket; corner modules made from pyro-log, Type "R" fiber module; perimeter modules made from 12 lb/cu ft ceramic fiber accordion pleated module (2400° F.); interior modules made from 9.3 lb/cu ft 2400° F. ceramic fiber accordion pleated module; deck support made from extruded pyrophylite or cordierite posts to support deck grid assembly; and a grid assembly made from cordieritc round, hollow stringers supported by solid cordierite beams.

Although a preferred embodiment and specific example of the invention has been described, the invention is not to be limited thereto. Various modifications will be apparent to those skilled in the art, and the invention is to be defined and limited only by the following claims.

I claim:

1. An ultra low profile kiln for firing bricks stacked in a kiln car traveling continuously through the kiln without stopping, said kiln having an entrance end and an exit end and defining therebetween an ultra low profile tunnel through which a kiln car loaded with bricks is conveyed, said bricks having a maximum load height on said kiln car of 18 inches or less, said kiln comprising:

a preheat zone through which combustion gases are drawn to preheat the bricks;

a furnace zone disposed behind said preheat zone, said furnace zone having a plurality of burners for firing the bricks, said plurality of burners mounted so that none of said burners are below the load of the bricks on the kiln car, and a cooling zone disposed behind said furnace zone and adjacent the exist end of said kiln for cooling the bricks.

2. The ultra low profile kiln of claim 1, wherein said kiln further comprises a ware cooling zone located between said direct cooling zone and said exit end of said kiln for further cooling of the bricks prior to exiting said kiln, and wherein cooling air is supplied by a fan at the exit end.

3. The ultra low profile kiln of claim 1 wherein said kiln includes a framework base, an insulating layer on said framework base, and a brick ware support deck;

said brick ware support deck being spaced from said insulating layer to allow heat to circulate under said deck; and said brick ware support deck having an open grid pattern to allow for even and quick drying and firing of the brick ware.

4. The ultra low profile of claim 3, wherein said insulating layer comprises a low density insulation made from fiber having a density less than 25 lb./cu. ft.

5. The ultra low profile of kiln of claim 3, wherein said insulating layer comprises ceramic fiber modules.

6. The ultra profile kiln of claim 3, wherein said insulating layer comprises a base layer, perimeter modules, and interior modules.

7. The ultra low profile kiln of claim 3, wherein said brick ware support deck is supported above said framework base on posts fixed to said framework base.

8. An ultra low profile kiln for firing bricks stacked in a kiln car traveling continuously through the kiln without stopping, said kiln having an entrance end and an exit end and defining therebetween an ultra low profile tunnel through which a kiln car loaded with bricks having a stack height of 18 inches or less is conveyed, said kiln comprising:

a preheat zone through which combustion gases are drawn to preheat the bricks;

a furnace zone disposed behind said preheat zone, said furnace zone having a heat source for firing the bricks, said heat source mounted so that it is above the load of bricks stacked on the kiln car;

a cooling zone disposed behind said furnace zone and adjacent the exit end of said kiln for cooling the bricks;

said kiln car including a framework base, a fiber insulating layer on said framework base, and a brick ware support deck;

said brick ware support deck spaced from said insulating layer to allow heat to circulate under said deck; and said brick ware support deck having an open grid pattern comprising a plurality of beams supported by posts fixed to said framework base, and a plurality of stringers spanning between said beams to allow for even and quick dying and firing of the brick ware.

9. An ultra low profile kiln assembly for firing bricks stacked in a kiln car, said kiln assembly comprising:

a kiln having an entrance end and an exit end and defining therebetween an ultra low profile tunnel through which a kiln car loaded with bricks is conveyed continuously without stopping;

a kiln car adapted to be conveyed continuously through said kiln without stopping;

a load of bricks stacked on said kiln car to a load height no greater than 18 inches;

said kiln having a plurality of burners for firing said bricks in said kiln, said burners mounted in said kiln so that none of said burners are below the load of said bricks on said kiln car.

* * * * *